US008448485B1

(12) United States Patent
Widén

(10) Patent No.: US 8,448,485 B1
(45) Date of Patent: May 28, 2013

(54) LOCK AND KEY COMBINATION WITH ROTATABLE LOCKING TUMBLERS

(75) Inventor: Bo Widén, Torshälla (SE)

(73) Assignee: Winloc AG, Zug (CH)

( * ) Notice: Subject to any disclaimer, the term of this patent is extended or adjusted under 35 U.S.C. 154(b) by 0 days.

(21) Appl. No.: 13/458,333

(22) Filed: Apr. 27, 2012

(30) Foreign Application Priority Data

Mar. 22, 2012 (SE) ..... 1250282

(51) Int. Cl.
*E05B 27/00* (2006.01)

(52) U.S. Cl.
USPC ..... 70/494; 70/409; 70/378; 70/496

(58) Field of Classification Search
USPC ..... 70/493–496, 378, 409
See application file for complete search history.

(56) References Cited

U.S. PATENT DOCUMENTS

| | | | | |
|---|---|---|---|---|
| 3,999,413 | A | 12/1976 | Raymond et al. | |
| 4,635,455 | A | 1/1987 | Oliver | |
| 4,732,022 | A | 3/1988 | Oliver | |
| 5,067,335 | A * | 11/1991 | Widen | 70/495 |
| 5,682,779 | A | 11/1997 | Doley | |
| 5,956,986 | A | 9/1999 | Vonlanthen | |
| 6,173,595 | B1 | 1/2001 | Hughes | |
| 6,257,033 | B1 | 7/2001 | Ziv-Av | |
| 7,159,424 | B2 * | 1/2007 | Widen | 70/409 |
| 7,370,502 | B2 * | 5/2008 | Widen | 70/493 |
| 7,487,653 | B2 * | 2/2009 | Widen | 70/409 |
| 7,621,163 | B2 * | 11/2009 | Widen | 70/493 |
| 7,665,336 | B2 * | 2/2010 | Widen | 70/409 |
| 7,698,921 | B2 | 4/2010 | Almagor et al. | |
| 7,810,364 | B2 * | 10/2010 | Widen | 70/409 |
| 8,061,168 | B2 * | 11/2011 | Widen | 70/409 |
| 8,156,777 | B1 * | 4/2012 | Widen | 70/409 |
| 8,230,708 | B2 * | 7/2012 | Widen | 70/409 |
| 8,281,628 | B2 * | 10/2012 | Widen | 70/409 |
| 2007/0028658 | A1 | 2/2007 | Widen | |

FOREIGN PATENT DOCUMENTS

| | | | |
|---|---|---|---|
| AT | 392 508 | B | 4/1991 |
| EP | 1 236 849 | A1 | 9/2002 |
| EP | 1 712 714 | A1 | 10/2005 |
| EP | 1 635 012 | A2 | 3/2006 |
| ES | 2368543 | A1 | 11/2011 |
| GB | 1 223 142 | | 2/1971 |
| NO | 309618 | B1 | 2/2001 |
| WO | WO 96/27724 | A1 | 9/1996 |
| WO | WO 99/64703 | A1 | 12/1999 |

(Continued)

*Primary Examiner* — Suzanne Barrett
(74) *Attorney, Agent, or Firm* — Birch, Stewart, Kolasch & Birch, LLP

(57) ABSTRACT

A lock and key combination wherein at least one locking tumbler includes a key sensing portion, a body portion and a locking portion. A cavity, accommodating an associated locking tumbler, is larger than the contour of the body portion so as to permit a translatory as well as a rotary movement of the locking tumbler in a movement plane within the cavity. A code pattern on the key blade includes at least one wave-like guiding surface. When the key blade is inserted into the key slot, the locking tumbler is controlled by two mutually spaced formations, which engage with the wave-like guiding surface of the key blade, and is guided at opposite side surfaces by two associates walls of the cavity, to be retained precisely in the movement plane. The locking portion of the locking tumbler is movable to enable the locking mechanism to be released.

20 Claims, 14 Drawing Sheets

FOREIGN PATENT DOCUMENTS

| | | | |
|---|---|---|---|
| WO | WO 03/062570 | A1 | 7/2003 |
| WO | WO 2006-098675 | A1 | 9/2006 |
| WO | WO 2008-011089 | A2 | 1/2008 |
| WO | WO 2011/053317 | A1 | 5/2011 |

* cited by examiner

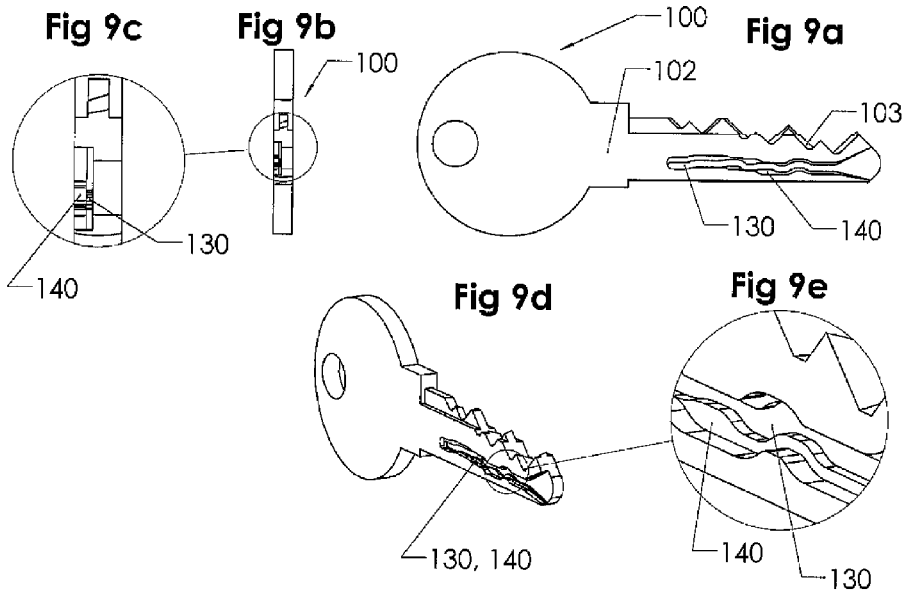
Fig 9c
Fig 9b
100
130
140
100
Fig 9a
102
103
130
140
Fig 9d
Fig 9e
130, 140
140
130
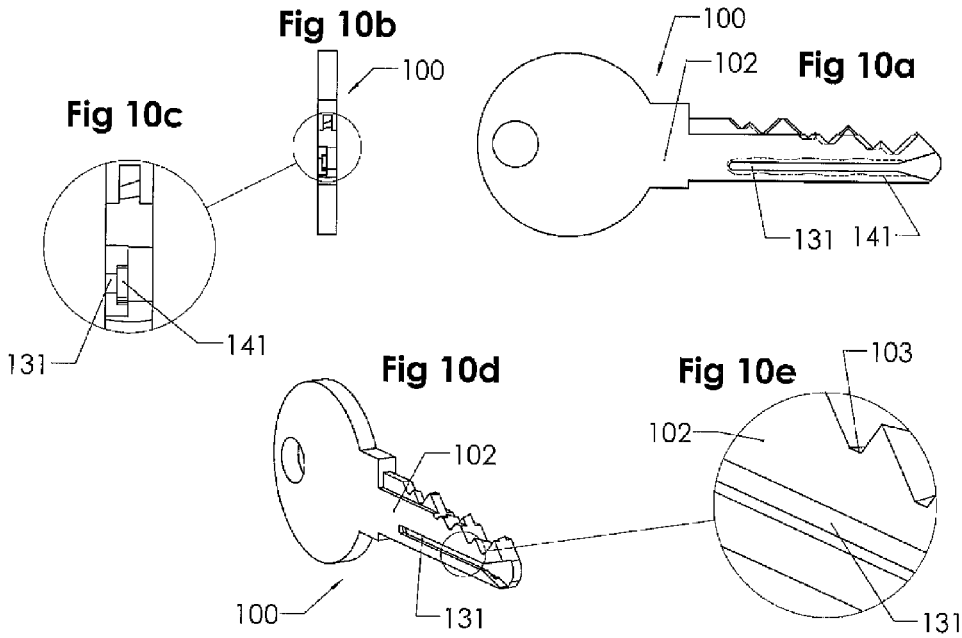
Fig 10b
100
Fig 10c
131
141
100
102
Fig 10a
131
141
Fig 10d
Fig 10e
103
102
102
100
131
131

LOCK AND KEY COMBINATION WITH ROTATABLE LOCKING TUMBLERS

FIELD AND BACKGROUND OF THE INVENTION

The present invention relates to a lock and key combination including

- a lock having a cylindrical bore accommodating a rotatable key plug with a longitudinally extending key slot for receiving a key blade and at least one locking tumbler arranged in said key plug for engagement with a code pattern on said key blade, and
- a key with said key blade,
- said at least one locking tumbler having
  - a key sensing portion, which is provided with two mutually spaced formations configured to engage with said code pattern on said key blade,
  - a body portion, which is rotatably journalled in a cavity in said key plug, and
  - a locking portion, which is formed on said body portion and is configured to cooperate with a locking mechanism adapted to lock said key plug against rotation unless a key blade with a correctly cut code pattern is inserted into the lock,
- said two mutually spaced formations on said key sensing portion being located so as to define a specific rotary position of said body portion upon inserting the key blade fully into the key slot, thereby releasing said locking mechanism and permitting rotation of said key plug in said cylindrical bore.

The invention also relates to a lock forming part of such a lock and key combination, a key for opening such a lock, and a key blank for making such a key.

A lock and key combination of the kind referred to above is previously known from the patent specification U.S. Pat. No. 6,257,033 B1 (ZIV-AV). In this prior art combination each locking tumbler is constituted by a pin accommodated in a cylindrical cavity in the key plug, the pin being displaceable along and rotatable about the longitudinal axis of the cylindrical cavity. Each pin has an engagement end, located in the key slot of the key plug and being formed with two mutually spaced lugs or "engagement features". These lugs will engage with associated depressions forming part of a code pattern on one side of a key blade.

The two depressions are separated by an intermediate ridge and are configured in such a way that the lugs of the associated pin will find their way down into the respective depression and cause the pin to rotate around its longitudinal axis. For this purpose, the code pattern on the side of the key includes a number of discrete depression pairs, these pairs being separated from each other and being distributed substantially in line with the cylindrical cavities and the associated pins, when the key is fully inserted into the key slot of the key plug of the lock.

Accordingly, when the key blade is fully inserted into the lock, the various locking pins will be rotated into predetermined rotational and axial positions so as to release the lock and permit rotation of the key plug in the cylindrical bore of the lock.

OBJECT OF THE INVENTION

Against this background, the object of the present invention is to provide a lock and key combination of the kind referred to in the first paragraph above, where each locking tumbler has a different kind of mobility and offers a great variety of well-defined positions which will release the locking mechanism.

Another object is to ensure a high level of security against picking the lock.

SUMMARY OF THE INVENTION

These objects are achieved for a lock and key combination where the body portion of said at least one locking tumbler has two opposite, substantially flat side surfaces and a peripheral edge surface forming a contour, and each cavity, accommodating an associated locking tumbler, is larger than the contour of said body portion so as to permit a translatory as well as a rotary movement of the locking tumbler in a movement plane within said cavity. Thus, the locking tumbler is mobile, not only in respect of linear displacement along an axis and rotation around a rotary axis (in the prior art being the same axis as the one permitting a linear movement), but also for movement in two dimensions in a plane, involving translatory as well as rotary movements. In this way, the locking tumbler may be moved into a plurality of possible positions.

In order to control the position of the locking tumbler in a predetermined way, the code pattern on the key blade comprises at least one wave-like guiding surface extending longitudinally along the key blade. Thus, the key sensing portion of the locking tumbler, provided with two mutually spaced formations, will make a controlled and continuous contact with the longitudinal guiding surface on the key blade, when the latter is being inserted into the key slot of the lock. Accordingly, the locking tumbler will perform well-defined translatory as well as limited rotary movements in said movement plane.

Furthermore, according to the present invention, the locking tumbler will be guided at its opposite side surfaces by two associated walls of the cavity, and will thus be retained precisely in said movement plane.

During insertion of the key into the lock, the locking portion of the locking tumbler will be moved into a final position enabling the locking mechanism to be released.

It will be evident to those skilled in the art that such a structure of the lock will open up a great variety of configurations of the locking tumblers and the mobility thereof. A number of possible embodiments will be described below and will also be defined in the appended claims.

The two mutually spaced formations on the key sensing portion of the locking tumbler may be constituted by protrusions which engage with the longitudinally extending guiding surface on the associated key blade. The guiding surface may comprise at least one longitudinal groove located on at least one side surface on the key blade. There may be one such longitudinal groove or two of them, each engaging with an associated one of the two protrusions on the key sensing portion. The groove or grooves may be configured in different ways, as will be discussed further below.

The body portion of the locking tumbler, having two opposite side surfaces and a peripheral edge surface forming a contour, may be embodied in different ways. It may be elongated, e.g. configured substantially like a letters "I" or "L", or an "inverted T", or substantially triangular, or it may be configured as a circular disc or with some other shape confined within a circular contour.

Thus, the lock and key combination according to the invention may be embodied in numerous ways.

The invention will now be explained in more detail, with reference to the appended drawings which show a number of examples of possible embodiments, it being understood that other embodiments may also fall within the scope of the claims.

SHORT DESCRIPTION OF THE DRAWINGS

Figure 3B:
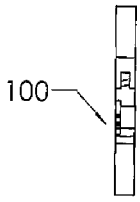
Figure 3A:
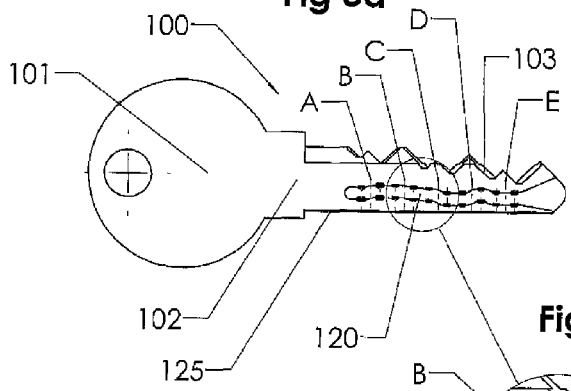
Figure 3A:
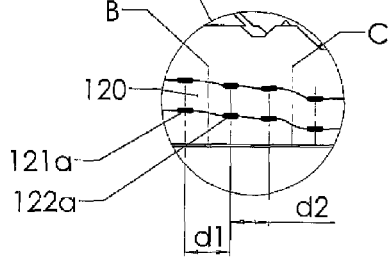

FIG. 3*a* shows the key in a side view;

FIG. 3*a*' shows an enlarged portion of a code pattern on the side of the key blade;

FIG. 3*b* shows an end view of the key in FIG. 3*a;*

Figure 1:
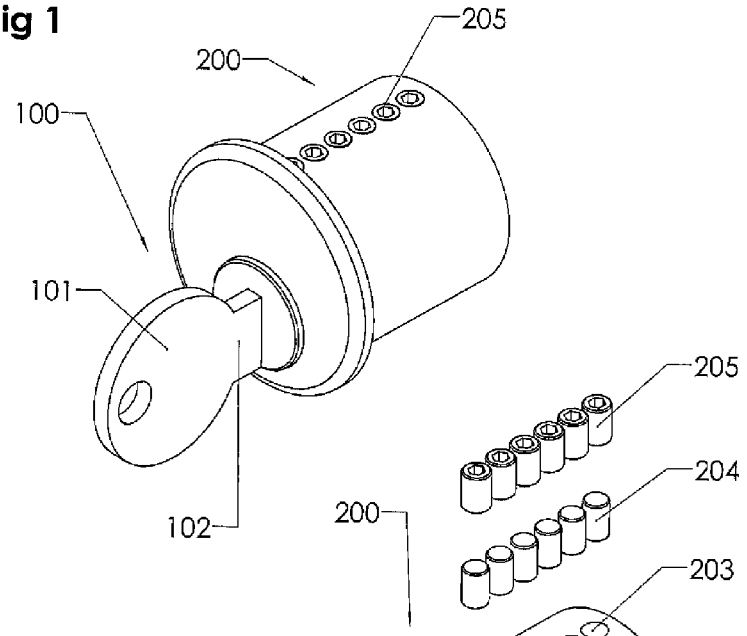
FIG. 1 shows in a perspective view a cylinder lock with an inserted key.
Figure 2:
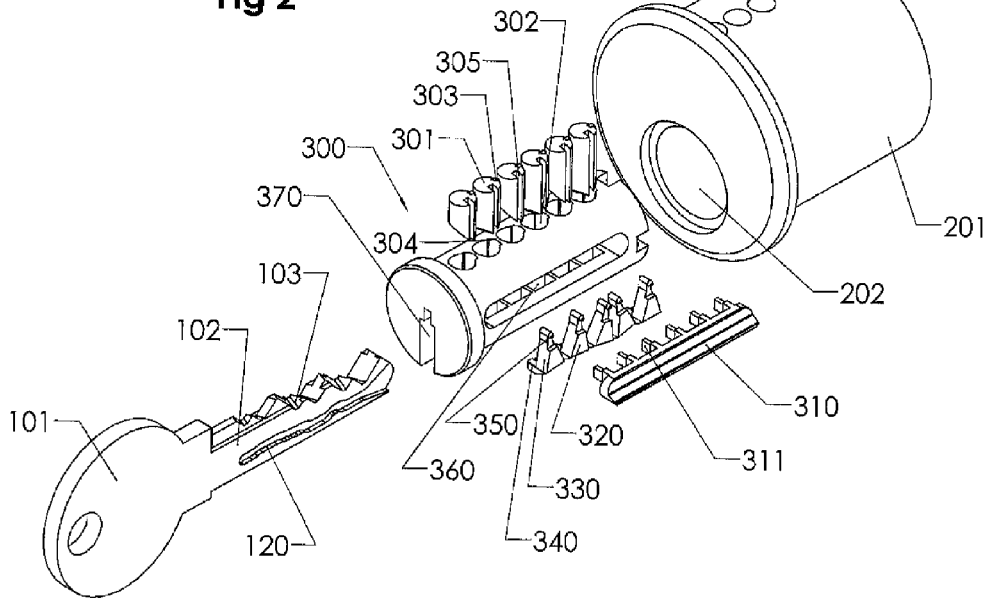
FIG. 2 shows the lock and key combination in a schematic exploded view showing only the essential parts of the lock.
Figure 3C:
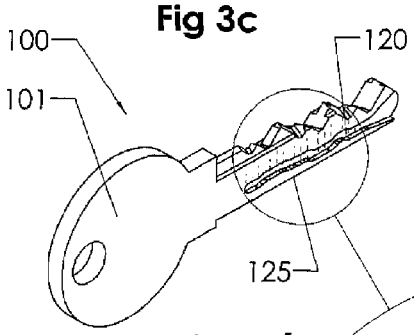
Figure 3C:
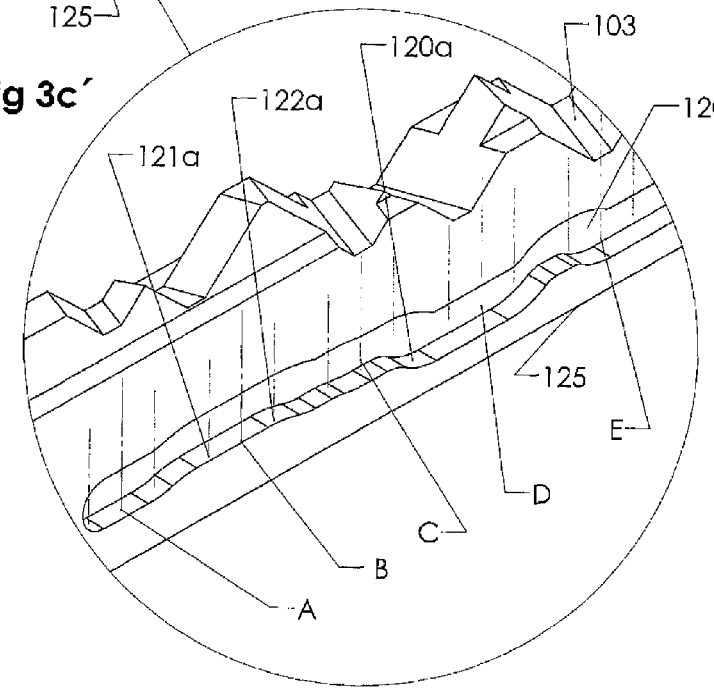
Figure 4B:
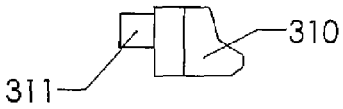
Figure 4A:
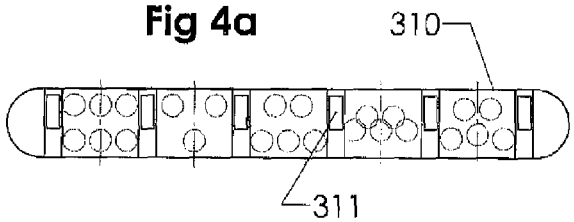
Figure 4D:
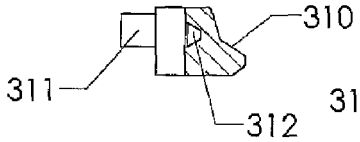
Figure 4C:
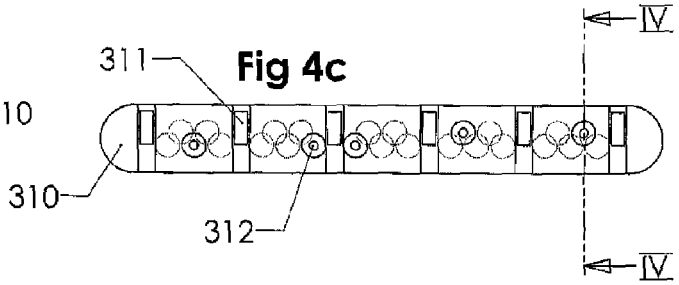

FIG. 3*c* shows the key of FIG. 3*a* in a perspective view;

FIG. 3*c*' shows an enlarged portion of the key blade of FIG. 3*c*, with two different code patterns;

FIG. 4*a* shows, in a side view, a side bar of the lock shown in FIGS. 1 and 2;

FIG. 4*b* shows the side bar of FIG. 4*a* in an end view;

FIG. 4*c* shows a particular side bar of the kind shown in FIG. 4*a*, with specific locations of code recesses;

FIG. 4*d* shows a cross section along the line IV-IV in FIG. 4*c;*

Figure 4E:
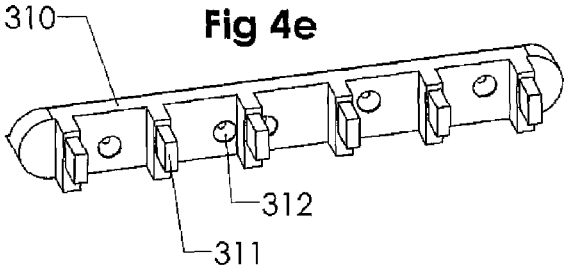
Figure 4F:
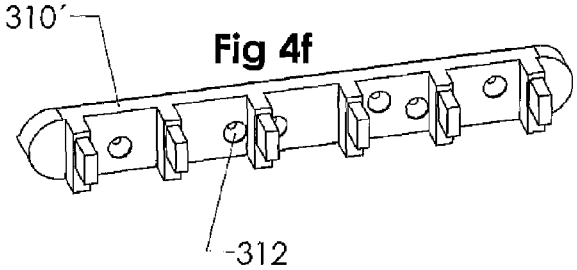
Figures 5A, 5B, 5C:
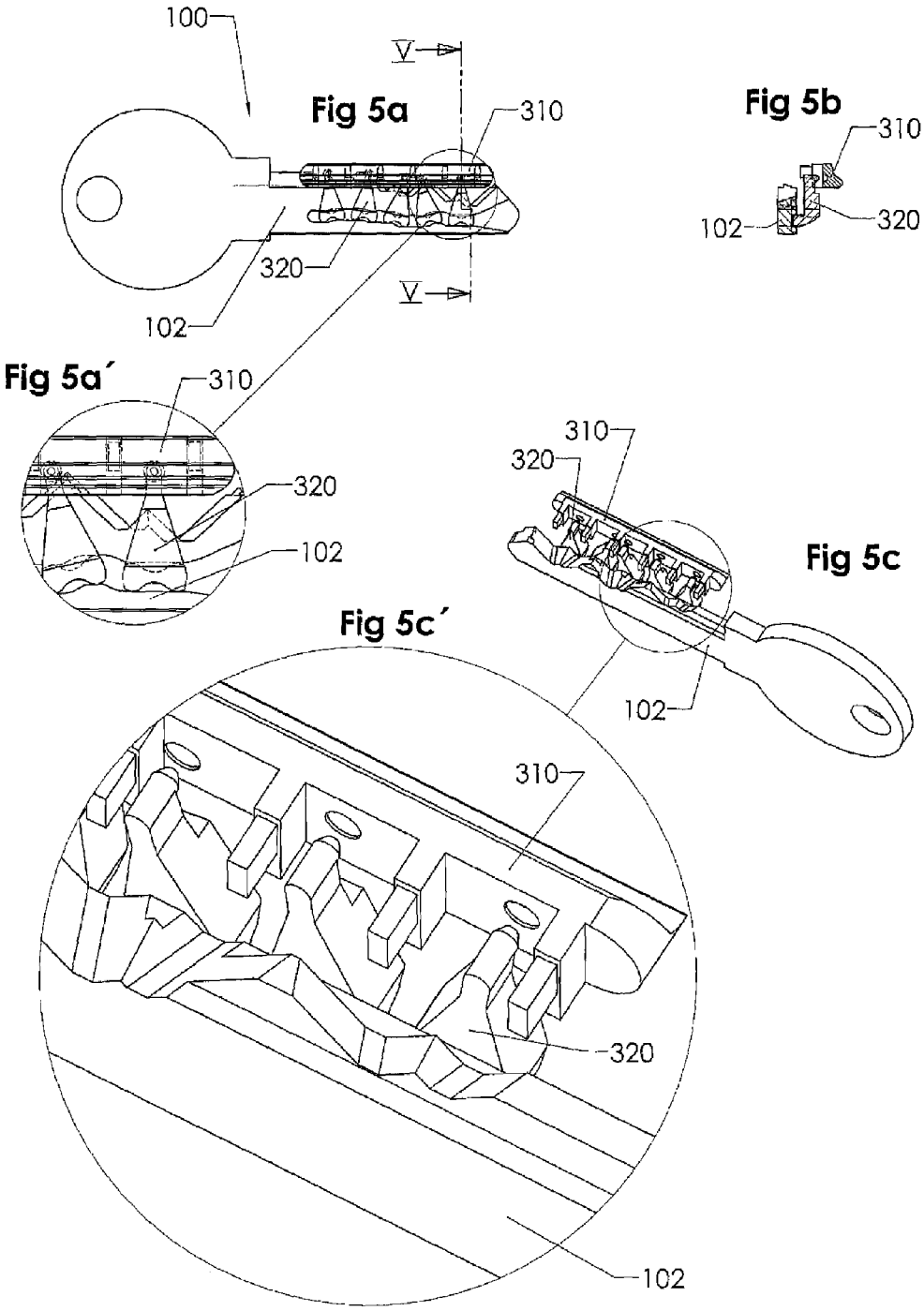

FIG. 4*e* shows the side bar of FIG. 4*c* in a perspective view;

FIG. 4*f* shows a similar side bar as in FIG. 4*e*, with a double code;

FIG. 5*a* shows schematically, in a side view, the key and various parts of the lock shown in FIGS. 1 and 2;

FIG. 5*a*' shows an enlarged part of a portion of the key blade and two associated side locking tumblers and a portion of the side bar of the lock;

FIG. 5*b* shows a cross section along the line V-V in FIG. 5*a;*

FIG. 5*c* shows, in a perspective view from above, the key and parts of the lock shown in FIG. 5*a;*

FIG. 5*c*' shows an enlargement of a portion of FIG. 5*c;*

Figure 6A:
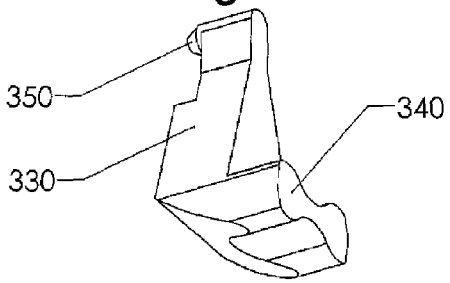

FIG. 6*a* shows, in a perspective view, a locking tumbler of the kind shown in FIGS. 2, 5*a*, 5*a*', 5*b*, 5*c* and 5*d;*

Figure 6B:
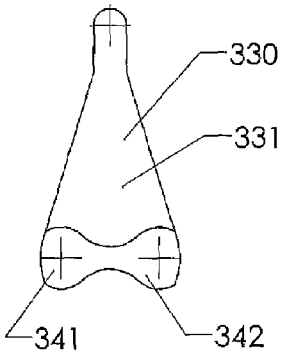
Figure 6C:
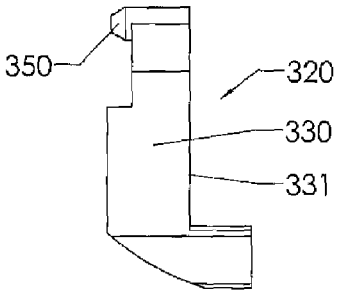
Figure 6D:
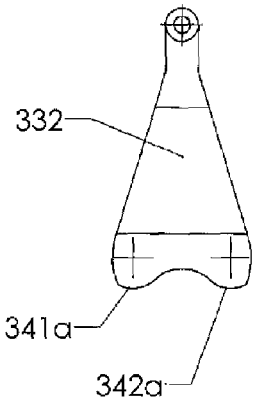
Figure 7B:
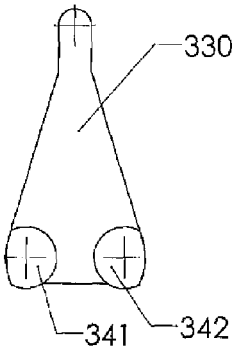
Figure 7A:
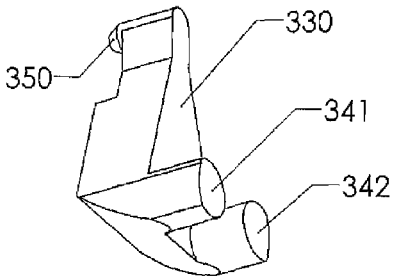
Figure 8A:
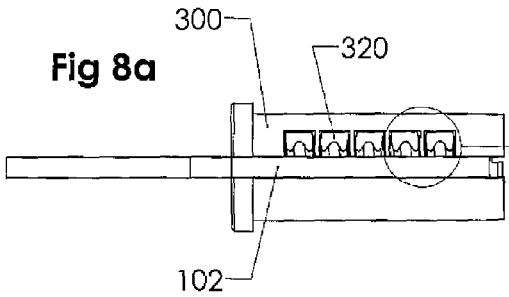
Figure 8H:
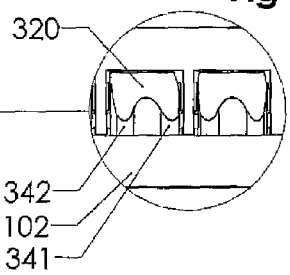

FIG. 6*b* shows the tumbler of FIG. 6*a* in a front view;

FIG. 6*c* shows the tumbler of FIG. 6*a* in a side view;

FIG. 6*d* shows the tumbler of FIG. 6*a* in a rear view;

FIGS. 7*a* and 7*b* show a similar locking tumbler as in FIG. 6*a* in a slightly different embodiment in a perspective view and a front view, respectively;

FIG. 8*a* shows, in a view from underneath, the lock and key of FIGS. 1 and 2, the key being inserted into the lock;

FIG. 8*h* shows an enlargement of a portion of FIG. 8*a;*

Figure 8B:
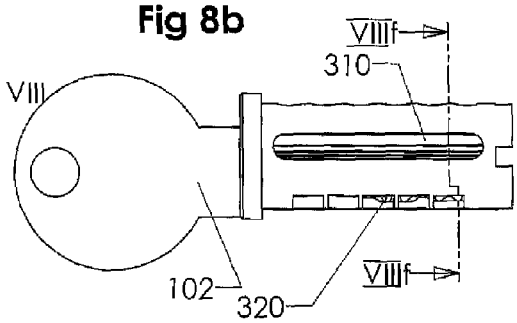
Figure 8C:
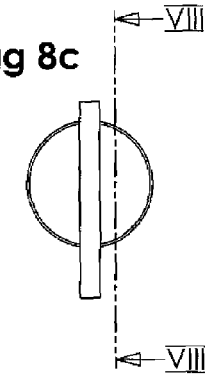
Figure 8F:
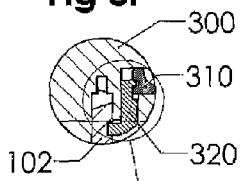
Figure 8D:
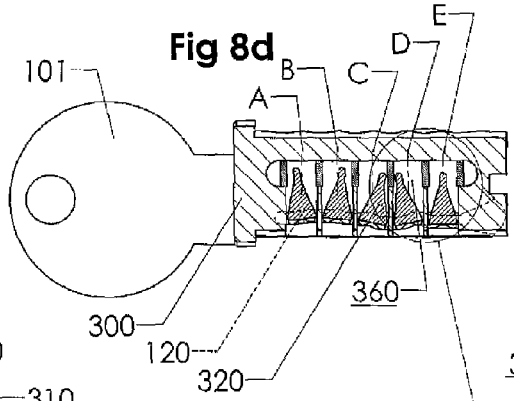

FIG. 8*b* shows the lock and key of FIG. 8*a* in a side view;

FIG. 8*c* shows the lock and key of FIG. 8*a* in an end view;

FIG. 8*d* shows a longitudinal section through the key plug along the line VIII-VIII in FIG. 8*c;*

Figure 8G:
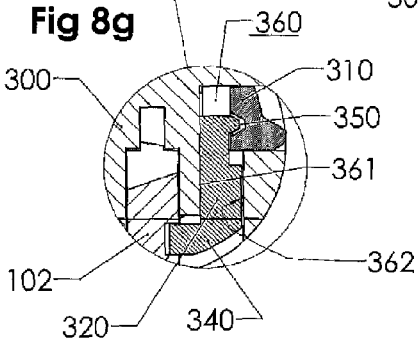
Figure 8E:
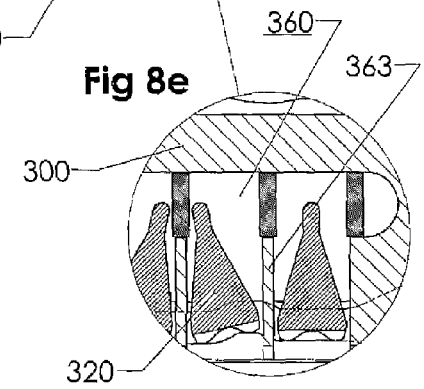

FIG. 8*e* shows an enlarged portion of FIG. 8*d;*

FIG. 8*f* shows a cross section through the key plug, along the line VIIIf-VIIIf, with an inserted key of FIG. 8*b;*

FIG. 8*g* is an enlarged portion of FIG. 8*f;*

FIG. 9*a* shows, in a side view, a key with a double side code pattern;

FIG. 9*b* shows a front view of the key of FIG. 9*a;*

FIG. 9*c* is an enlarged portion of FIG. 9*b;*

FIG. 9*d* is a perspective view of the key of FIG. 9*a;*

FIG. 9*e* is an enlarged portion of FIG. 9*d;*

FIG. 10*a* is a side view of a key according to a further embodiment;

FIG. 10*b* is a front view of the key of FIG. 10*a;*

FIG. 10*c* is an enlarged portion of FIG. 10*b;*

FIG. 10*d* is a perspective view of the key of FIG. 10*a;*

FIG. 10*e* is an enlarged portion of FIG. 10*d;*

Figure 11A:
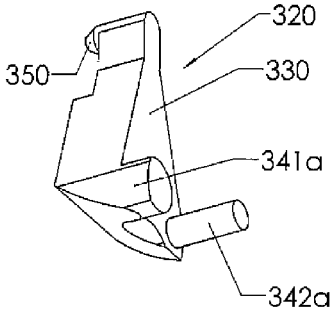
Figure 12A:
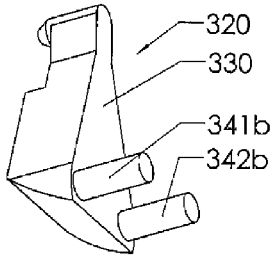
Figure 13A:
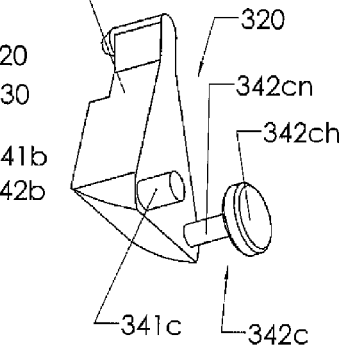
Figure 11B:
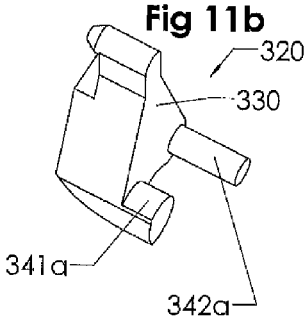
Figure 12B:
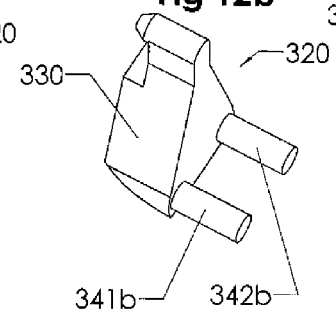
Figure 13B:
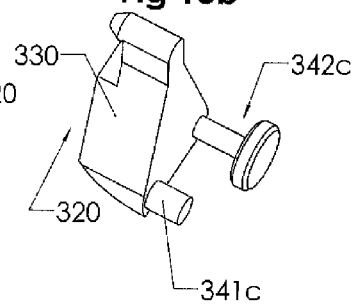
Figure 14A:
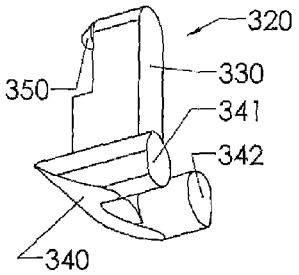
Figure 14B:
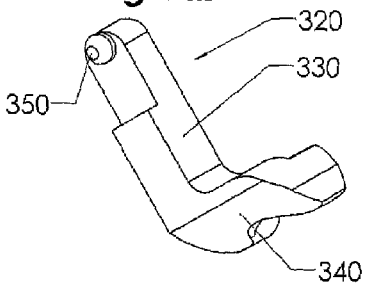
Figure 14C:
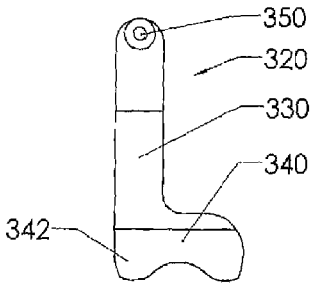
Figure 15A:
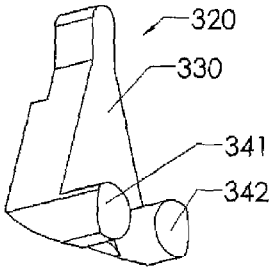
Figure 15B:
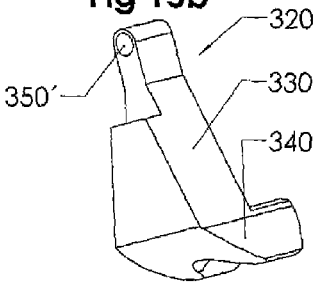
Figure 15C:
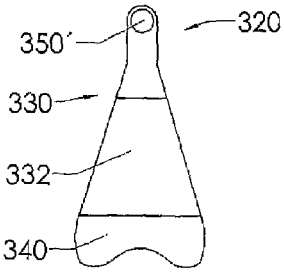
Figure 16A:
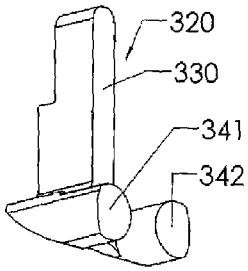
Figure 16B:
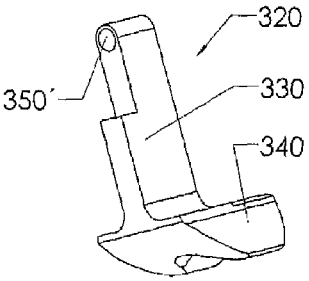
Figure 16C:
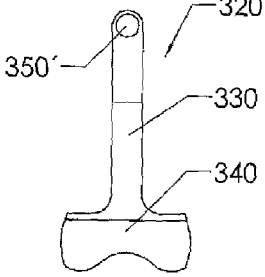
Figure 22C:
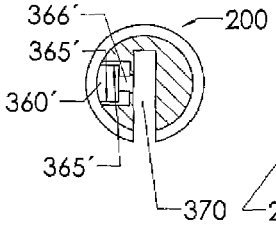
Figure 22A:
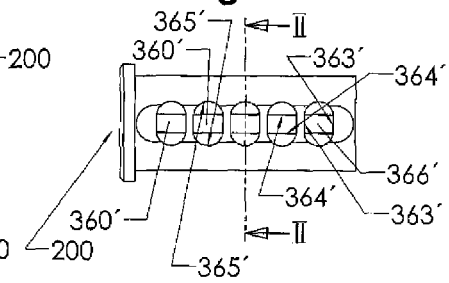
Figure 22B:
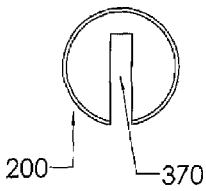

FIGS. 11*a* and 11*b* show two different perspective views of a side locking tumbler with two different protrusions;

FIGS. 12*a* and 12*b* show two perspective views of a side locking tumbler having two protrusions of the same kind;

FIGS. 13*a* and 13*b* show two different perspective views of a side locking tumbler having two protrusions, one of them having a widened end portion;

FIGS. 14*a*, 14*b* and 14*c* are different views of a side locking tumbler having a L-configuration;

FIGS. 15*a*, 15*b* and 15*c* show different views of a side locking tumbler having a triangular configuration;

FIGS. 16*a*, 16*b* and 16*c* illustrate a locking tumbler having a configuration like an inverted T;

FIGS. 17*a*, 17*b* and 17*c* and 18 show a locking tumbler having a configuration like the letter I;

FIGS. 19*a*, 19*b*, 19*c* and 19*d* show a locking tumbler configured as a circular disc;

FIGS. 20*a*, 20*b*, 20*c* and 20*d* show a different embodiment with a different configuration, also being circumscribed by a circular contour;

FIGS. 21*a*, 21*b*, 21*c* and 21*d* show a further embodiment, also being circumscribed by a circular contour;

FIG. 22*a* shows, in a side view, a key plug with a row of transversal elongated cavities;

FIG. 22*b* is an end view of the key plug in FIG. 22*a;*

FIG. 22*c* is a cross sectional view along the line II-II in FIG. 22*a;*

Figure 23A:
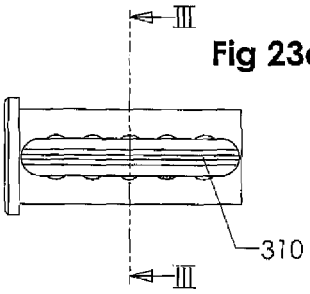
Figure 23B:
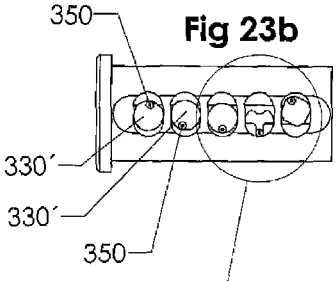
Figure 23D:
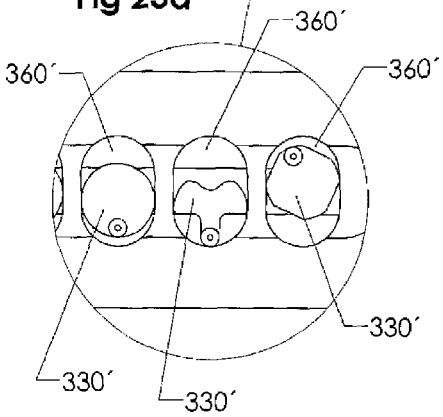
Figure 23C:
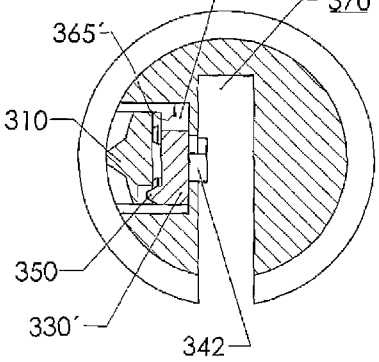

FIG. 23*a* is a similar view as in FIG. 22*a*, including a side bar;

FIG. 23*b* is a side view of a key plug with a row of mutually different locking tumblers;

FIG. 23*c* is a cross sectional view along the line III-III in FIG. 23*a;*

FIG. 23*d* is an enlarged portion of FIG. 23*b;*

Figure 24A:
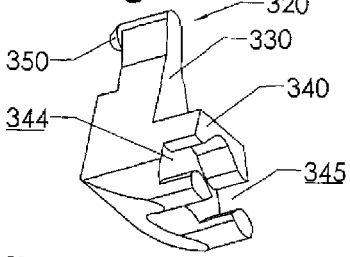
Figure 24B:
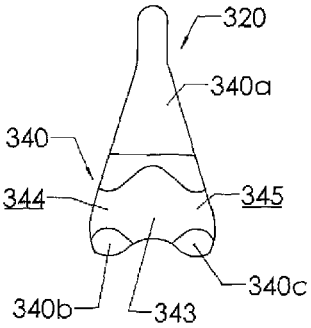

FIG. 24*a* shows in a perspective view a different embodiment of a side locking tumbler having a key sensing portion provided with recesses rather than protrusions;

FIG. 24*b* shows a front view of the locking tumbler of FIG. 24*a;*

Figure 24C:
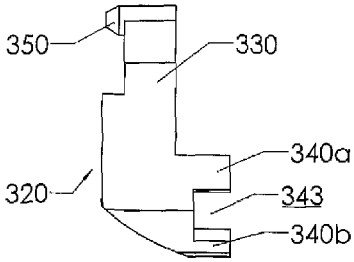

FIG. 24*c* shows a side view of the locking tumbler 24*a;*

Figure 24D:
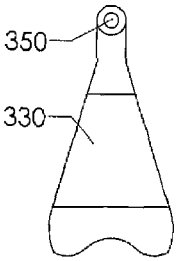

FIG. 24*d* shows a rear view of the locking tumbler of FIG. 24*a;*

Figure 25:
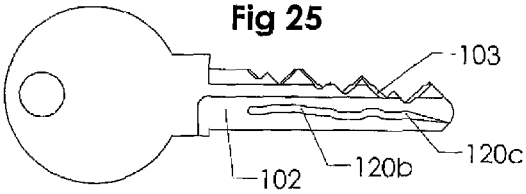

FIG. 25 shows in a side view a key fitting with the tumbler of FIG. 24*a;*

Figure 26A:
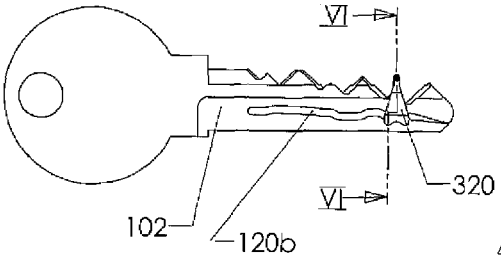
Figure 26B:
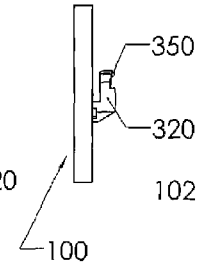

FIG. 26*a* shows the key of FIG. 25, including also a locking tumbler;

FIG. 26*b* shows an end view from the left of FIG. 26*a;*

Figure 26C:
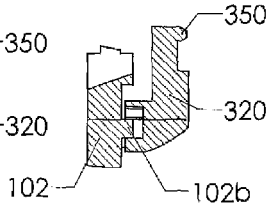

FIG. 26*c* shows a cross section along the line VI-VI in FIG. 26*a;*

FIGS. 27*a*, 27*b*, 27*c* and 27*d* show different views of a circular locking tumbler having a key sensing portion similar to the one in FIG. 24*a;*

Figure 27A:
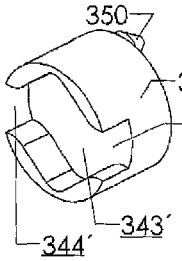
Figure 27B:
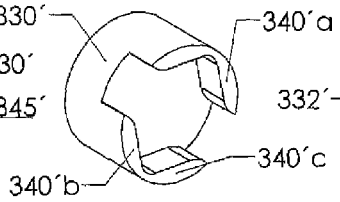
Figure 27C:
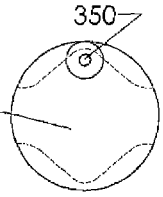
Figure 27D:
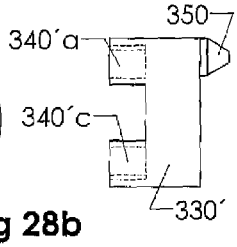
Figure 28A:
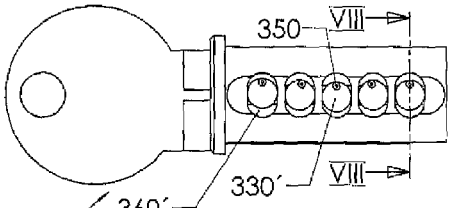

FIG. 28*a* shows a key plug, an inserted key and circular tumbiers of the kind shown in FIGS. 27*a*, 27*d;*

Figure 28B:
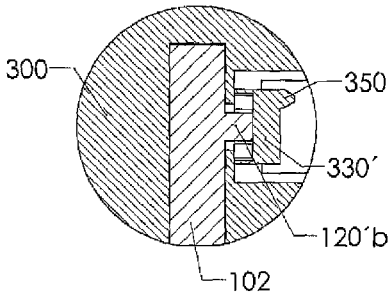

FIG. 28*b* shows a cross section along the line VIII-VIII in FIG. 28*a;*

Figure 29:
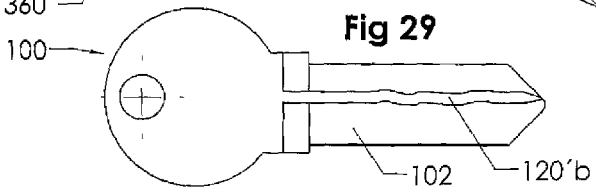
Figure 30A:
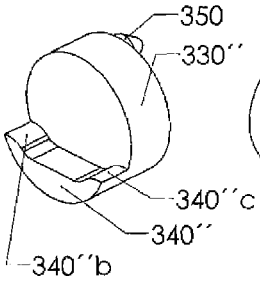
Figure 30B:
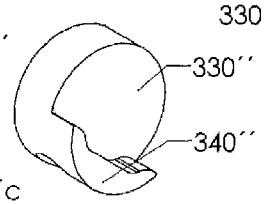
Figure 30C:
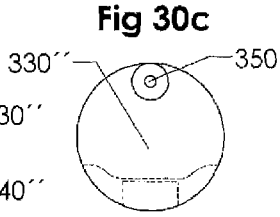
Figure 30D:
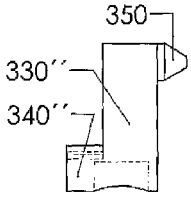
Figure 31:
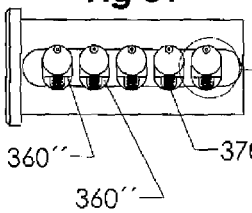
Figure 32:
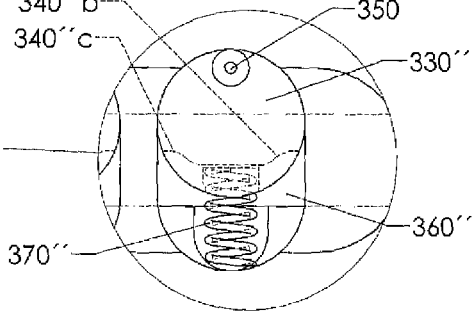
Figure 33A:
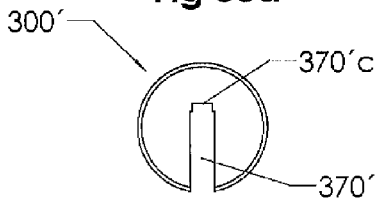
Figure 33B:
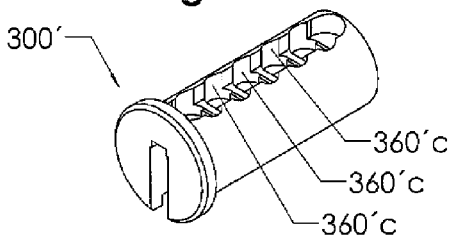

FIG. 29 shows a side view of the key of FIG. 28*a*, without the key plug;

FIGS. 30*a*, 30*b*, 30*c* and 30*d* show different views of a circular locking tumbler with a one-sided key sensing portion;

FIG. 31 shows a side view of a key plug with spring-loaded locking tumblers of the kind shown in FIG. 30*a*, etc.;

FIG. 32 shows an enlarged portion of FIG. 31;

FIG. 33*a* shows a front view of a key plug with horizontal locking tumblers;

FIG. 33*b* shows a perspective view of the key plug of FIG. 33*a;*

Figure 34:
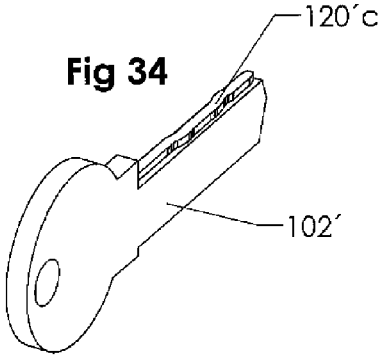
Figure 35:
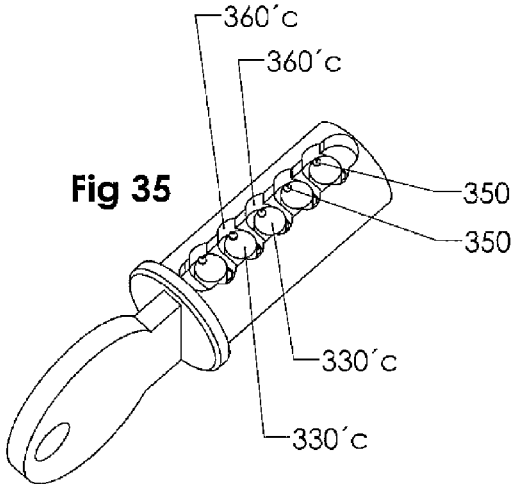

FIG. 34 shows a perspective view of a key with a wave-like ridge at the top edge, fitting with the key plug of FIGS. 33*a*, 33*b*; and FIG. 35 shows the key plug of FIGS. 33*a*, 33*b* with an inserted key, as shown in FIG. 34, in a perspective view.

DETAILED DESCRIPTION OF PREFERRED EMBODIMENTS

In FIG. 1 there is shown a cylinder lock 200 with an inserted key 100 having a grip portion 101 and a key blade 102 (most of the key blade is only visible in FIG. 2). As appears from FIG. 2, the lock 200 includes a housing 201 having an inner cylindrical bore 202 accommodating a key plug 300, and a row of upper holes 203, each accommodating an upper pin 204 and a closing plug 205. Under each closing plug 205, there is a helical spring (not shown) urging the associated upper pin 204 downwards so as to contact the upper surface of a respective lower pin 301 in the key plug 300. For this purpose, there is a row of cylindrical upper holes 302 in the upper part of the key plug. These lower pins 301 each have an outer longitudinal rib 303 fitting in an associated longitudinal recess 304 making it possible for the lower pin 301 to rotate in a limited angular interval. The lower ends of the lower pins 301 cooperate with chisel-shaped cuts 103 at the upper edge portion of the key blade 102. In this way, the lower pins will be oriented in predetermined rotational positions when the key blade 102 has been fully inserted into the key plug 300. Accordingly, a longitudinal groove 305 will be positioned so as to accommodate a corresponding one of a number of lugs 311 on a side bar 310. As is known per se in the art, the side bar is resiliently movable radially inwards in the key plug 300. When all the lugs 311 are accommodated in the associated longitudinal grooves 305 of the lower pins 301, the side bar will be moved inwards and inside the shear line between the key plug 300 and the cylindrical bore 202 of the housing 200, thereby enabling rotation of the key plug 300 within the housing 201. Such rotation will only be possible when a correctly cut key 100 has been fully inserted into the lock. The locking mechanism described so far is in itself previously known.

According to the present invention, the lock also includes at least one locking tumbler 320 arranged in the key plug 300 for engagement with an associated code pattern on the key blade 102. This locking tumbler 320 (see FIGS. 6*a*, 6*b*, 6*c*, 6*d*, 7*a*, 7*b*, 8*d*, 8*e*, 11*a*, 11*b*, 12*a*, 12*b*, 13*a*, 13*b*, 14*a*, 14*b*, 14*c*, 15*a*, 15*b*, 15*c*, 16*a*, 16*b*, 16*c*, 17*a*, 17*b*, 17*c*, 18, 19*a*, 19*b*, 19*c*, 19*d*, 20*a*, 20*b*, 20*c*, 20*d*, 21*a*, 21*b*, 21*c*, 21*d*, 24*a*, 24*b*, 24*c*, 24*d*, 27*a*, 27*b*, 27*c* and 27*c*) has a body portion 330, a key sensing portion 340 and a locking portion 350. The locking portion 350 cooperates with the side bar 310, the key plug being locked against rotation unless a key blade with a correctly cut code pattern is inserted into the lock, and each locking tumbler is located in a final, well-defined position where the locking portion, in most embodiments constituted by a protrusion or lug, engages with a corresponding recess (not visible in FIG. 2) in the side bar 310.

Each locking tumbler is accommodated in an associated cavity 360 in the key plug 300. The cavity 360 is larger than the contour of the body portion 330 of the locking tumbler 320. In this way, the locking tumbler 320 can perform a rotary movement as well as a translatory movement (see e.g. FIGS. 8*d*, 8*e*) within the cavity 360 in a movement plane. In this embodiment (FIG. 2) the movement plane is vertical and is parallel to a central plane of the key slot 370 into which the key blade 102 can be inserted. During such movements, the body portion 330 is retained in its vertical movement plane because of two opposite, substantially flat side surfaces 331, 332 which are in sliding contact with two associated walls 361, 362 (FIG. 8*g*) defining the cavity 360.

One important aspect of the present invention is that the locking tumbler 320 is movable in its entirety, both in a translatory or translational movement and in a rotary movement about a rotary axis. In the embodiment of FIGS. 1 and 2, the rotary axis is perpendicular to the central plane of the key slot 370. Normally, when the key blade 102 is inserted into the key slot 370, the locking tumblers 320 will perform a combined translatory and rotary movement. These movements of the locking tumblers 320 are well illustrated in FIGS. 8*d* and 8*e*.

The rotary and translatory movements of the locking tumblers are controlled by the code pattern 120 on the key blade 102. For this purpose, the locking tumbler 320 is provided with a key sensing portion 340 (FIG. 6*a*) having two mutually spaced formations which engage with the code pattern 120. In this embodiment, the key sensing portion 340 includes two mutually spaced formations in the form of protrusions 341, 342, being either integrally formed as in FIGS. 6*a*, 6*b*, 6*c*, 6*d* or separated from each other, as shown in e.g. FIGS. 7*a* and 7*b*.

The code pattern 120 on the key blade 102 (see FIGS. 3*a* through 3*c*') comprises at least one wave-like guiding surface extending longitudinally along the key blade. In this example, the longitudinally extending guiding surface comprises a longitudinal groove on the side surface on the key blade. Alternatively, each locking tumbler may be spring-loaded against a wave-like surface on a shelf or the like, so that the two spaced formations 341, 342 on the key sensing portions are continually contacting the wave-like, longitudinally extending guiding surface on the key blade. See also FIGS. 31 and 32.

When the key blade 102 is being inserted into the key slot 370 of the key plug, the guiding surface on the side of the key blade, in this case the lower side surface 120*a* of the wave-like groove (see FIG. 3*c*') will continuously engage with the key sensing portion 340 of the locking tumbler, at two mutually spaced contact points 341*a*, 342*a* (FIG. 6*d*), thereby exerting a torque depending on the particular supporting points 121*a*, 122*a* of the wave-like guiding surface 120*a*. When these supporting points 121*a* and 122*a* are located at different levels, as illustrated in FIG. 3*a*' and FIG. 3*c*', the body portion 331 of the locking tumbler 320 will lean sideways in the movement plane, as also seen clearly in FIGS. 8*d* and 8*e*. During insertion of the key blade 102, the contact points 341*a*, 342*a* will contact different pairs of supporting points 121*a*, 122*a* and thereby cause a rotary or pivotal movement of the body portion 320. In FIG. 8*d* this is illustrated by showing five different locking tumblers being pivoted into five different pivotal positions, namely to the left, to the right, even more to the right, even more to the left and straight up, respectively.

In addition to the rotary or pivotal movement of each locking tumbler, there will also be an elevational or translational movement depending on the level of the guiding surface 120*a*, measured as a vertical distance from the lower straight edge 125 of the key blade 102 (FIG. 3*a*). The central vertical axes are denoted A, B, C, D and E in FIGS. 3*a*, 3*a*', 3*c*' and 8*d*. It will be apparent that the locking tumbler 320 in the cavity A is positioned at a higher level than the one in cavity E (see FIG. 8*d*). An important aspect of the present invention is that the mutually spaced formations 341, 342 on the key sensing portion 340 of the locking tumbler are widely spaced apart, and they are continually engaged with the wave-like guiding surface 120*a* of the key blade, when the latter is inserted into the key slot 370. Because of this engagement, each locking tumbler will be positioned in a controlled way, so that it will always take a well-defined position both in respect of its rotary position and in respect of its translatory or translational position in relation to the lower edge 125 of the key blade. At the same time, it will be precisely retained in the vertical plane defined by the two opposite walls 361, 362 (FIG. 8*g*) of the cavity 360.

Accordingly, the upper locking portion 350 of the locking tumbler 320 (see FIGS. 2, 6*a*, 6*c*) will always have a well-defined position, but it will be moved as a consequence of the transitory and rotary movements of the locking tumbler, into a final well-defined position when the key blade is fully inserted into the key slot 370. Then, each locking portion 350 (in the form of a lug in FIG. 6*a*) will register with a corresponding recess 312 at the inside of the side bar 310 (see FIGS. 4*c*, 4*e* and 4*f*).

When all the protrusions 311 register with the longitudinal slots 305 of the lower pins 301 (FIG. 2) and all the recesses 312 register with the locking portions 350 on the side locking tumblers 320, the side bar 310 will be movable radially inwards so as to enable rotation of the key plug 300 within the cylindrical bore 202 of the lock housing 201.

Since the locking tumbler 320 can be positioned at various vertical levels in relation to the lower edge of the key blade, and also at various pivotal positions, depending on the inclination of the two supporting points 121*a*, 122*a* of the guiding surface 120*a*, the locking portion 350 of the locking tumbler can be positioned in a plurality of different positions in relation to the side bar 310, as illustrated in FIG. 4*a*. In this figure, there are shown various code patterns, with up to six different locations, in each cavity. Possibly, by using three different vertical levels the number of possible code locations may be at least eight. Of course, by changing the overall dimensions of the cavities, the locking tumblers and the wave-like guiding surface on the key blade, the number of possible code locations may be changed at will, even up to very large numbers. The ones shown in FIG. 4*a* are relatively easy to realize with normally dimensioned cylinder locks of this kind.

Moreover, the coding on the side bar may use more than one code location for each cavity 360, as shown in FIG. 4*f*, on the side bar 310'. As will be understood by those skilled in the art, such coding may be used for master-key systems, where a master-key has a code combination appearing on all side bars in a group of locks.

The mobility of the locking tumblers 320, in this embodiment being side locking tumblers arranged in a movement plane oriented in parallel at the side of the key slot 370, is further illustrated in FIGS. 5*a*, 5*a'*, 5*b*, 5*c*, 5*c'* and in FIGS. 8*a*-8*h*. These drawing figures also illustrate the interaction between the key blade 102, the locking tumblers 320 and the side bar 310. From FIGS. 8*d* and 8*e* it will also be apparent that the cavities 360 are separated in the longitudinal direction of the key plug by partition walls 363. In this embodiment these partition walls 363 align with the lugs of the side bar. The lugs serve as stop members or abutment walls for the uppermost parts of the locking tumblers in their respective pivotal or rotary end positions. Of course, as an alternative, the upper portions of the partition walls may be configured to serve as such stop members or abutment walls, if at all necessary.

Going back to FIGS. 3*a*-3*c*, it will be evident that the spacing of the supporting points 121*a*, 122*a* of the wave-like guiding surface 120*a* is such that the longitudinal distance d1 (FIG. 3*a'*) between these points is larger than the distance d2 between the respective pairs of contact points associated with each cavity of the lock. In other words, each code segment, each including a pair of separate code portions or supporting points of the wave-like longitudinally extending guiding surface 120*a*, is longer (d1) than the shortest distance (d2) between any two adjacent code segments of the longitudinal guiding surface or groove forming the code pattern 120.

By way of such a spacing of the supporting points of the guiding surface 120*a*, each locking tumbler will be very well controlled in terms of its rotary or pivotal position, when the key has been fully inserted into the key slot. In conjunction with the side walls of the cavity 360, retaining the locking tumbler 320 precisely in its movement plane, the positioning of each locking tumbler 320 will be exact and will insure a proper and reliable operation of the locking mechanism.

In the basic embodiment (illustrated in FIGS. 1 and 2, and other drawings figures), the guiding surface 120*a* on the key blade 102 is one of the sidewalls of a single groove extending longitudinally along the key blade. As an alternative, it is possible to have a code pattern constituted by two longitudinal grooves 130, 140. As illustrated in FIGS. 9*a*, 9*b*, 9*c*, 9*d* and 9*e*, one such groove 130 is relatively narrow and deep, whereas the other groove 140 is shallow and relatively wide.

The deep groove 130 is confined within the contours of the shallow groove 140.

The two grooves 130, 140 may engage with a respective one of the two protrusions 341*a*, 342*a* at the key sensing portion 340 of the locking tumbler 320. A first one (341*a*, FIGS. 11*a*, 11*b*) of these protrusions is relatively short and wide and will fit into the wide groove 140, whereas the other one (342*a*) is longer and relatively small in diameter so that it fits into the narrow, deep groove 130. In order to allow for different configurations of the two grooves 130, 140, the wide groove 140 should be much wider than the narrow groove 130, preferably at least twice as wide, and preferably 2.5-3.0 times as wide. In this way, one of these grooves may be inclined upwardly, whereas the other one may be inclined downwardly in the same longitudinal region. In any case, with such dimensions, there is a great flexibility in respect of the configurations of these two grooves.

At least for one or some of the locking tumblers, it is possible to provide two protrusions of the same kind, e.g. both being wide and short (as in FIGS. 6*a* through 6*d*, 7*b*, 7*a*) or both being long and narrow (as shown in FIGS. 12*a* and 12*b* for the protrusions 341*b* and 342*b*).

It is not strictly necessary that the narrow groove 130 is confined within the contours of the wider groove 140. These two grooves may cross each other, provided that the crossing angle is rather large.

As an alternative, it is also possible to have one relatively narrow groove 131 (see FIGS. 10*a*, 10*b*, 10*c*, 10*d* and 10*e*) and a relatively deep groove 141 which is undercut and much wider in its innermost portion (FIGS. 10*a* and 10*c*). The wider innermost portion of the deep groove 141 is preferably twice as wide as the narrow groove 131, and most preferably 2.5-3.0 times as wide.

In this embodiment, the locking tumbler 320 (see FIGS. 13*a*, 13*b*) is provided with one short protrusion 341*c*, fitting into the relatively narrow groove 131, and a second protrusion 342*c* having a very narrow neck portion 342*cn* and a wide head 342*ch*, the latter fitting in the undercut portion of the groove 141. The neck portion 342*cn* of the protrusion 342*c* must be much narrower than the diameter of the other protrusion 341*c* so that the protrusion 342*c* can follow the wave-like variations of the undercut groove 141. Preferably, the protrusion 341*c* is twice as wide as the neck portion 342*cn* and most preferably at least 2.5 times wider.

It is possible that the narrow groove 131 is wave-like. However, in the illustrated embodiment, the narrow groove 131 is straight. Accordingly, the locking tumbler will perform a pivoting movement around the axis of the protrusion 341*c* when the key blade is inserted into the key slot. Since the protrusion 341*c* is located at a corner of the locking tumbler 320, the movements of the locking tumbler 320 will be both rotational and translational, since the geometrical centre of the locking tumbler will move vertically when the locking tumbler is pivoted around the axis of the protrusion 341*c*.

Figure 18:
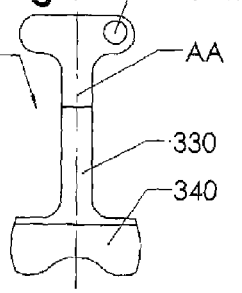

The geometrical shape of the locking tumbler 320, or rather the body portion thereof, may differ from the triangular configuration illustrated so far in FIGS. 2, 5*a*, 5*a*', 5*c*, 5*d*, 6*a* through 6*d*, 7*a*, 7*b*, 8*d*, 8*e*, 11*a, b*, 12*a, b* and 13*a, b*. In FIGS. 14*a* etc., 15*a* etc., 16*a* etc., 17*a* etc., FIG. 18 is various shapes are illustrated, all of them having a body portion which is elongated and extends from a key sensing portion along a body axis, the locking portion being located at a distance, along this body axis, from the key sensing portion. In all these cases, the rotary movement is a pivoting movement around a pivot axis. Also, the pivot axis is located at the key sensing portion, which extends substantially in the longitudinal direction of the key plug. However this key sensing portion will change its inclinational angle relative to a longitudinal axis of the key plug, as a consequence of its engagement with the wave-like, longitudinally extending guiding surface o the key blade. During such a pivoting movement, the locking portion will be displaced substantially in the longitudinal direction of the key plug into a well-defined final position, when the key blade is being inserted into the key slot.

In FIGS. 14*a*, 14*b*, 14*c*, the body portion 330 extends as a linear shank from the locking portion or lug 350 to one (342) of the protrusions or fingers 341, 342 projecting transversely outwardly at the key sensing portion 340. As appears from FIG. 14*c*, the body portion or shank 330 and the key sensing portion 340 together have a shape substantially like the letter "L".

The shape of the body portion 330 shown in FIGS. 15*a*, 15*b*, 15*c*, is basically the same (i.e. triangular) as the one shown in FIGS. 7*a* and 7*b*. The only difference of this embodiment is that the locking portion is constituted by a recess 350' rather than a projecting lug 350. In such an embodiment, the side bar should be provided with projecting lugs fitting into the recesses 350', rather than recesses as shown in FIGS. 4*a* through 4*f*.

The embodiment shown in FIGS. 16*a*, 16*b*, 16*c*, is similar to the previous embodiment. However, the body portion 330 is formed as a central, linear shank, so that it is formed, together with the key sensing portion 340, as an inverted "T" letter. The whole locking tumbler 320 will pivot around an axis located on a straight line connecting the two protrusions 341, 342, depending on the configurations of the groove or grooves on the key blade.

Figure 17A:
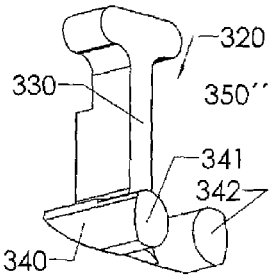
Figure 17B:
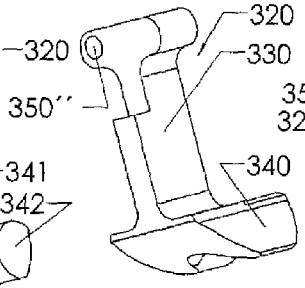
Figure 17C:
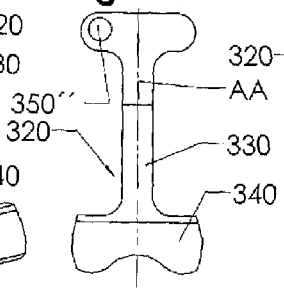

A still further embodiment is shown in FIGS. 17*a*, 17*b*, 17*c*, and FIG. 18, the shape of the body portion 330, including the locking portion and the key sensing portion 340, being shaped like the letter "I". This embodiment is similar to the one in FIGS. 16*a*, 16*b*, 16*c*, except that the upper locking portion is widened in the transverse direction, as seen in FIG. 17*c* and FIG. 18. In FIG. 17*c*, the locking portion, constituted by a recess 350", is offset relative to the body axis AA, to the left in FIG. 17*c*, and to the right in FIG. 18.

The locking tumbler does not have to be triangular or elongated as in the previous examples. In fact, the locking tumbler may be shaped as a disc being confined within a circular contour. In the embodiment shown in FIGS. 19*a*, 19*b*, 19*c* and 19*d*, the body portion 330' of the locking tumbler 320 is shaped as a circular disc (see FIG. 19*c*) having two opposite, substantially flat side surfaces 331' and 332', which are parallel to each other. From the side surface 331', two protrusions 341, 342 project axially. In this embodiment, these protrusions are located along a diameter across the circular contour, adjacent to the peripheral edge surface of the body portion. On the other side, at the opposite side surface 332' (FIG. 19*c*), there is a locking portion in the form of a projecting lug 350. The protrusions 341, 342 and the lug 350 operate exactly like the corresponding parts in the previous embodiments. The cavities 360' (see FIGS. 22*a* and 22*c*), accommodating the circular locking tumblers, are elongated with two opposite walls 363' (FIG. 22*a*) located at a mutual distance corresponding to the diameter of the circular disc 330' and two semi-circular end portions 365' (see also FIGS. 23*a, b, c, d*). Like in the previous embodiment, there is also a passage way 366' (FIG. 22*c*) which extends from the respective cavity 360' to the key slot 370. This passageway 366' has upper and lower stop surfaces 364' (FIG. 22*a*) serving as stop members for limiting the rotary movement of the circular disc 330'. As shown in FIGS. 23*b* and 23*d*, the circular discs or locking tumblers 330' can be placed into the cavities 360' with the locking portion or lug 350 being situated in either the upper part of the cavity 360' or in the lower part of the cavity 360'. See the two discs to the left in FIG. 23*b*.

Although the shape of the locking tumbler 330' (circular) is quite different from the shape of the locking tumblers 320 in the previous examples, it will be understood that these circular discs will rotate about their central axes and interact with the key blade 102 and the side bar 310 (FIGS. 23*a*, 23*c*) in basically the same way as in the previous embodiments. The circular disc 330' can rotate in a limited angular interval, and it can also move upwards and downwards in the elongated cavities 360'. The opposite surfaces 364' (FIG. 22*a*) in the passage ways 366' will serve as abutment or stop members for the protrusions 341, 342 when the circular disc 330' is rotated, while the protrusions 341, 342 are guided by the guiding surface on the key blade.

Figure 20A:
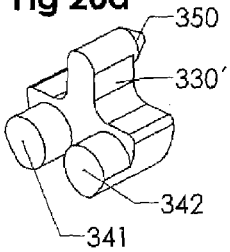
Figure 20B:
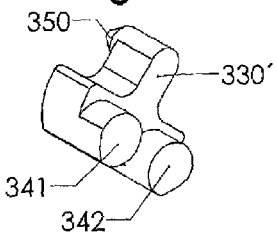
Figure 20C:
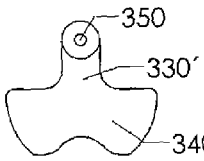
Figure 20D:
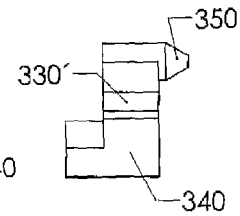

The body portion 330' does not have to extend all around the circular contour but may have recesses, as shown in FIGS. 20*a, b, c, d* and 21*a, b, c, d*, respectively. In the embodiment of FIGS. 20*a, b, c, d*, the body portion 330' is still confined within a circular contour but has a base portion with two protrusions 341, 342 and an upright, central body portion 330', at the top of which there is a locking portion or lug 350.

Figure 19A:
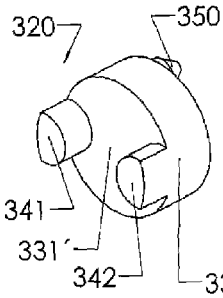
Figure 19B:
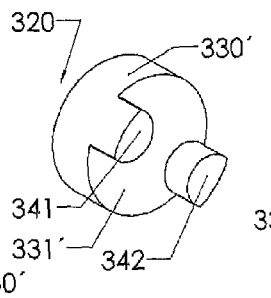
Figure 19C:
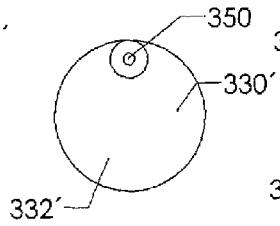
Figure 19D:
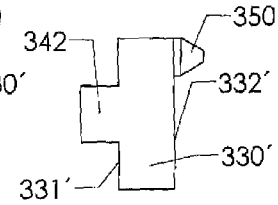
Figure 21A:
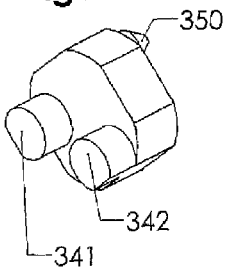
Figure 21B:
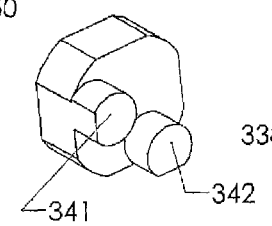
Figure 21C:
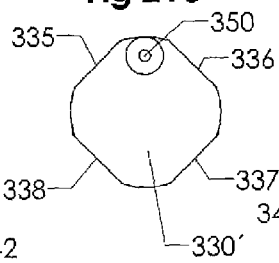
Figure 21D:
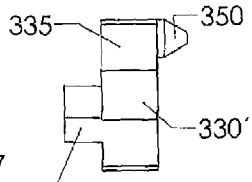

In the embodiment shown in FIGS. 21*a, b, c, d*, the peripheral edge surface of the locking tumbler is a little different, with four linear edge portions (FIG. 21*c*) 335, 336, 337 and 338, but it will be apparent that these embodiments (FIG. 20*a* etc., 21*a* etc.) operate just like the circular disc shown in FIG. 19*a* etc. This will also be apparent from FIGS. 23*b* and 23*d* illustrating these three different locking tumblers mounted in three different cavities 360'.

In the previous examples, the guiding surface 120, 120*a* on the key blade is constituted by a side wall surface of a groove engaging with protrusions on the locking tumbler. However, as illustrated in FIGS. 24*a, b, c, d*, FIG. 25 and FIGS. 26*a, b, c*, it is possible to have a reverse embodiment, i.e. with a ridge on the key blade and corresponding recesses on the locking tumbler.

Accordingly, on the key blade 102 shown in FIG. 25 there is a longitudinally extending ridge 120*b* having a wave-like configuration and having a pointed end 120*c* at the tip of the key blade. Like in the embodiment shown in FIG. 2, this key blade 102 also has a code pattern at the upper edge, with chisel-shaped cuts 103.

The wave-like ridge 120*b* on the key blade 102 engages with corresponding recesses in the key sensing portion 340 of the locking tumbler 320 (see FIGS. 24*a, b* and *c*). As appears is best from FIG. 24*b*, the key sensing portion 340 includes a longitudinally (along the key plug and the key blade) extending channel 343 with two mutually spaced formations or recesses 344, 345 defined by an upper part 340*a* of the key sensing portion 340 and two lower parts or lugs 340*b* and 340*c*.

The longitudinally spaced formations or recesses 344, 345 are dimensioned so as to slidingly engage, with some minor play, with the wave-like longitudinally extending ridge 120*b* on the key blade 102, when the latter is being inserted into the key slot of the lock. Therefore, the interaction between the key blade 102 and the locking tumbler 320 will be basically the same as in the embodiment illustrated in FIG. 2. Likewise, the locking tumbler 320 with its locking portion or lug 350 will move in the same way as in the previous embodiments.

The embodiment shown in FIGS. 27*a, b, c, d*, FIGS. 28*a, b* and FIG. 29 corresponds to those shown in FIGS. 19*a, b, c, d*, although with a key sensing portion with recesses 343', 344', 345' instead of protrusions, and to FIGS. 23*b*, 23*c*, and to FIG. 25. However, the wave-like ridge 120'*b* on the key blade 102 has a varying width, as appears from FIG. 29. Such a modified configuration of the ridge 120'*b* is appropriate to enable the desired rotary movements of the circular discs 330' when the key blade 102 is inserted into the key slot of the key plug 300. In all other respects, this embodiment will operate in the same manner as the previous embodiments.

In FIGS. 30*a, b, c, d*, 31 and 32, there is shown a modified embodiment of the locking tumbler 330" having a one-sided key sensing portion 340" with two mutually spaced formations 340"*b* and 340"*c*. Here, in each cavity 360" (FIGS. 31, 32) a helical spring 370" will resiliently hold the locking tumbler or disc 330" in engagement with the associated ridge or guiding surface 120'*b* on the key blade 102 (FIG. 29). It follows, with such a pressure spring, that the groove 120 in the embodiment shown in FIGS. 2, 3*c* and 3*c'* can be replaced by a wave-like shelf surface on the side of the key blade.

Moreover, it would be possible to have such a wave-like guiding surface at the top edge of the key blade rather than the chisel-shaped cuts shown in the previous embodiments. Such an embodiment is illustrated in FIGS. 33*a*, 33*b*, 34 and 35.

In this lock and key combination, the key blade 102' is provided with a longitudinally extending, wave-like ridge 120'*c* at its upper edge, as seen in FIG. 34. This ridge portion 120'*c* is similar to the ridge portions shown in FIGS. 25 and 29, except for its location and orientation. The ridge portion 120'*c* is confined within a limited region inside the vertical planes defined by the planar side surfaces of the key blade 102', and the key slot 370' is provided with a slightly narrower upper portion 370'*c* accommodating the wave-like ridge portion 120'*c*, as seen best in FIG. 33*a*.

The key plug 300' has upper recesses 360'*c*, each of them accommodating an associated locking tumbler in the form of a circular disc 330'*c* of the same kind as shown in FIGS. 19*a, b, c, d* or FIGS. 27*a, b, c, d*. These recesses 360'*c* may be configured like the recesses 360' in FIG. 22*a* or 28*a*. Accordingly, the circular discs 330'*c* can rotate around their central axes in a limited angular interval and are provided with upper lugs 350 which fit into corresponding holes or recesses in a side bar (not shown but being of the same kind as the one shown in FIG. 23*a*).

In this embodiment, the movements of the circular discs 360'*c*, serving as locking tumblers, are performed in a movement plane which extends in parallel to the rotational axis of the key plug 300' but which is oriented at right angle (transversely) to the central plane of the key slot 370'.

Of course, it is possible to replace the fidge portion 120'*c* by a groove, like the groove 120 or grooves 130, 140 shown in FIGS. 31 and 9*a*, respectively, although situated on the upper edge of the key blade. In that case, the circular discs 360'*c* should be provided with two mutually spaced protrusions on their lower side surfaces.

Also, it is possible to provide the side surface of the key blade 102' (FIG. 34) with a further code pattern (not shown) cooperating with a further side locking mechanism (also not shown) in the key plug.

Those skilled in the art may modify the embodiments shown in this description within the scope of the appended claims. For instance, the locking tumblers may be oriented in a movement plane which is inclined relative to the vertical movement plane in the embodiment of FIGS. 1, 2 or to the horizontal movement plane in the embodiment of FIG. 35. However, the movement plane should always be oriented in parallel to the rotary axis of the key plug 300; 300', and the locking tumblers are still guided for rotational and translational movements in such a movement plane, being guided by parallel side surfaces of the associated cavities. Moreover, the locking portion of each locking tumbler will be movable into a final well-defined position, when a correctly cut key blade is being pushed into its fully inserted position within the key plug, so as to enable the locking mechanism to be released.

The invention claimed is:

1. A lock and key combination including a lock (200) having a cylindrical bore (202) accommodating a rotatable key plug (300) with a longitudinally extending key slot (370) for receiving a key blade (102) and at least one locking tumbler (320) arranged in said key plug for engagement with a code pattern (120) on said key blade, and a key (100) with said key blade, said at least one locking tumbler (320) having a key sensing portion (340), which is provided with two mutually spaced formations (341, 342) configured to engage with said code pattern (120) on said key blade, a body portion (330), which is rotatably journalled in a cavity (360) in said key plug, and a locking portion (350), which is formed on said body portion and is configured to cooperate with a locking mechanism (310) adapted to lock said key plug against rotation unless a key blade with a correctly cut code pattern is inserted into the lock, said two mutually spaced formations (341, 342) on said key sensing portion being located so as to define a specific rotary position of said body portion (330) upon inserting the key blade fully into the key slot, thereby releasing said locking mechanism and permitting rotation of said key plug in said cylindrical bore, characterized in that said body portion (330) of said at least one locking tumbler has two opposite, substantially flat side surfaces (331, 332) and a peripheral edge surface forming a contour, said cavity (360), accommodating an associated one of said at least one locking tumbler, is larger than said contour of said body portion (330) so as to permit a translatory as well as a rotary movement of said locking tumbler in a movement plane within said cavity, said movement plane being parallel to the rotary axis of said key plug (300), and said code pattern on said key blade comprises at least one wave-like guiding surface (120*a*) extending longitudinally along said key blade (102), and said locking tumbler (320), when the key blade is being inserted into said key slot, is caused to perform well-defined translatory as well as limited rotary movements in said movement plane, while being controlled by said two mutually spaced formations (341, 342), which engage with said at least one wave-like, longitudinally extending guiding surface (120*a*) of the key blade, and also being guided at said two opposite, substantially flat side surfaces (331, 332) by two associated walls (361, 362) of said cavity (360), so as to be retained precisely in said movement plane, said locking portion (350) of said at least one locking tumbler being movable, as a consequence of said translatory and rotary movements, into a final well-defined position, enabling said locking mechanism (310) to be released.

2. A lock and key combination as defined in claim 1, wherein said cavity (360) is provided with oppositely arranged stop members limiting the rotary movement of said body portion between two rotary end positions.

3. A lock and key combination as defined in claim 1, wherein said two mutually spaced formations on said key sensing portion are protrusions (341, 342) which engage with said at least one wave-like, longitudinally extending guiding surface (120*a*) on the key blade.

4. A lock and key combination as defined in claim 3, wherein said at least one wave-like, longitudinally extending guiding surface on the key blade comprises at least one longitudinal groove (120) on at least one side surface of said key blade, and wherein said at least one locking tumbler is a side locking tumbler (320) having said two mutually spaced protrusions (341, 342) which cooperate with said at least one longitudinal groove.

5. A lock and key combination as defined in claim 4, wherein said at least one longitudinal groove comprises two grooves (130, 140), a first one (130) being deep and narrow and cooperating with a long protrusion (342*a*) on said locking tumbler (320) and a second one (140) being shallow and wide and cooperating with a short protrusion (341*a*) on said locking tumbler.

6. A lock and key combination as defined in claim 4, wherein each said longitudinal groove (120; 130, 140) has two opposite side walls located at a mutual distance corresponding to the width of the associated protrusion.

7. A lock and key combination as defined in claim 6, wherein said at least one longitudinal groove (141) is undercut with an outer, relatively narrow portion, and an inner, relatively wide portion, said relatively wide portion being dimensioned to accommodate a widened end portion (342*ch*) of an associated protrusion (342*c*) on said key sensing part of said at least one tumbler (320).

8. A lock and key combination as defined in claim 1, wherein said body portion (330) is elongated and extends from said key sensing portion (340) along a body axis, and said locking portion (350) is located at a distance, along said body axis, from said key sensing portion, said rotary movement being a pivoting movement in said cavity, around a pivot axis, and said key sensing portion (340) of said at least one locking tumbler extending substantially in the longitudinal direction of the key plug (300), but changing an inclinational angle relative to a longitudinal axis of the key plug, as a consequence of an engagement with said wave-like longitudinally extending guiding surface (120*a*), and thereby causing said pivoting movement of said body portion (330), whereby said locking portion (350) is displaced substantially in the longitudinal direction of the key plug into said well-defined final position when the key blade is being inserted into said key slot.

9. A lock and key combination as defined in claim 8, wherein said body portion (330) has a shape configured substantially like any one of the letters "I" or "L" or an "inverted T".

10. A lock and key combination as defined in claim 8, wherein the configuration of said body portion (330) is substantially triangular, as seen along said pivot axis, said two formations (341, 342) and said locking portion (350) being located at the three corners of the triangular configuration.

11. A lock and key combination as defined in claim 1, wherein said body portion (330') is configured as a disc and is confined within a circular contour, said cavity (360') is elongated with two opposite walls (363') located at a mutual distance corresponding to the diameter of said circular contour, said key sensing portion with said two mutually spaced formations (341, 342) is located on one of said opposite, substantially flat side surfaces of said disc-like body portion, said rotary motion being performed around a central axis of said circular contour, and said locking portion (350) is located at the opposite side surface of said disc-like body portion, at a distance from said central axis.

12. A lock and key combination as defined in claim 11, wherein said two mutually spaced formations (341, 342) are located along a diameter across said circular contour.

13. A lock and key combination as defined in claim 1, wherein said code pattern on the key blade comprises a longitudinally extending, wave-like ridge (120*b*), and said key sensing portion (340) of said locking tumbler (320) comprises a channel (343) with two mutually spaced recesses (344, 345) which engage with said wave-like ridge (120*b*).

14. A lock and key combination as defined in claim 1, wherein said locking tumbler (330") is biased by a spring (370") in said recess (360").

15. A lock (200) forming part of a lock and key combination, said lock having a cylindrical bore (202) accommodating a rotatable key plug (300) with a longitudinally extending key slot (370) for receiving a key blade (102) with a code pattern (120) and at least one locking tumbler (320) arranged in said key plug for engagement with said key blade, said at least one locking tumbler (320) having a key sensing portion (340), which is provided with two mutually spaced formations (341, 342) configured to engage with said code pattern (120) on said key blade (102), a body portion (330), which is rotatably journalled in a cavity (360) in said key plug, and a locking portion (350), which is formed on said body portion and is configured to cooperate with a locking mechanism (310) adapted to lock said key plug against rotation unless a key blade with a correctly cut code portion is inserted into the lock, said two mutually spaced formations (341, 342) on said key sensing portion being located so as to define a specific rotary position of said body portion (330) upon inserting the key blade fully into the key slot, said lock being characterized in that said body portion (330) of said at least one locking tumbler has two opposite, substantially flat side surfaces (331, 332) and a peripheral edge surface forming a contour, said cavity (360), accommodating an associated one of said at least one locking tumbler, is larger than the contour of said body portion (330) so as to permit a translatory as well as a rotary movement of said locking tumbler in a movement plane within said cavity, and said locking tumbler (320), when an associated key blade is inserted into said key slot, is caused to perform well-defined translatory as well as limited rotary movements in said movement plane, while being controlled by said two mutually spaced formations (341, 342), which engage with a wave-like, longitudinally extending guiding surface (120*a*) of the key blade, and also being guided at said two opposite, substantially flat side surfaces (331, 332) by two associated walls (361, 362) of said cavity (360), so as to be retained precisely in said movement plane, said locking portion (350) of said at least one locking tumbler being movable, as a consequence of said translatory and rotary movements, into a final well-defined position, enabling said locking mechanism (310) to be released.

16. A key (100) for opening a lock (200) as defined in claim 15, wherein said key comprises at least one wave-like, longitudinally extending guiding surface (120*a*), configured to engage with said two mutually spaced formations (341, 342) on the key sensing portion (340) of said at least one locking tumbler (320) of the lock, said at least one wave-like, longitudinally extending guiding surface comprising a longitudinal row (A . . . , E) of code segments, each including a pair of separate code portions of said at least one wave-like, longitudinally extending guiding surface, said pair of separate code portions (121*a*, 122*a*) being configured to engage with said mutually spaced formations on said key sensing portion of an associated locking tumbler, upon full insertion of said key blade into the associated lock, and said pair of separate code portions (121*a*, 122*a*) on the key blade are located in a plane which is parallel to a longitudinal axis of the key blade (102) and which is parallel to said movement plane of said locking tumbler (320) when the key blade is fully inserted into the lock.

17. A key as defined in claim 16, wherein each code segment in said row (A . . . , E) is longer (d1), in the longitudinal direction of said key blade, than the shortest distance (d2) between any two adjacent code segments in said row.

18. A key blank for manufacturing a key as defined in claim 16, wherein said key blank includes:

at least one wave-like, longitudinally extending guiding surface (120), configured to engage with said two mutually spaced formations (341, 342) on the key sensing portion (340) of said at least one locking tumbler (320) of an associated lock, said at least one wave-like, longitudinally extending guiding surface (120) comprising a longitudinal row (A, B, C, D, E) of code segments, each including a pair of separate code portions (121*a*, 122*a*) of said at least one wave-like, longitudinally extending guiding surface, said pair of separate code portions being configured to engage with said mutually spaced formations on said key sensing portion of an associated locking tumbler, upon full insertion of said key blade into the associated lock, said pair of separate code portions (121*a*, 122*a*) on the key blade are located in a plane, which is parallel to a longitudinal axis of the key blade (102) and which is parallel to said movement plane of said locking tumbler (320) when the key blade is fully inserted into the lock, wherein said key blank (102) also includes at least one further key blade portion for subsequent forming of an additional code pattern (103).

19. A lock and key combination as defined in claim 5, wherein each said longitudinal groove (120; 130, 140) has two opposite side walls located at a mutual distance corresponding to the width of the associated protrusion.

20. A lock and key combination as defined in claim 2, wherein said body portion (330) is elongated and extends from said key sensing portion (340) along a body axis, and said locking portion (350) is located at a distance, along said body axis, from said key sensing portion, said rotary movement being a pivoting movement in said cavity, around a pivot axis, and said key sensing portion (340) of said at least one locking tumbler extending substantially in the longitudinal direction of the key plug (300), but changing an inclinational angle relative to a longitudinal axis of the key plug, as a consequence of an engagement with said wave-like longitudinally extending guiding surface (120*a*), and thereby causing said pivoting movement of said body portion (330), whereby said locking portion (350) is displaced substantially in the longitudinal direction of the key plug into said well-defined final position when the key blade is being inserted into said key slot.

* * * * *